US006969059B2

(12) United States Patent
Gafner

(10) Patent No.: US 6,969,059 B2
(45) Date of Patent: Nov. 29, 2005

(54) DUAL MODULATED VACUUM SHINGLER

(75) Inventor: Jeffrey U. Gafner, Cambridge, WI (US)

(73) Assignee: Marquip, LLC, Phillips, WI (US)

( * ) Notice: Subject to any disclaimer, the term of this patent is extended or adjusted under 35 U.S.C. 154(b) by 26 days.

(21) Appl. No.: 10/620,906

(22) Filed: Jul. 16, 2003

(65) Prior Publication Data

US 2005/0012261 A1 Jan. 20, 2005

(51) Int. Cl.[7] ..... B65H 29/68
(52) U.S. Cl. ..... 271/69; 271/183
(58) Field of Search ..... 271/183, 202, 271/69

(56) References Cited

U.S. PATENT DOCUMENTS

| | | | | |
|---|---|---|---|---|
| 3,659,839 A | | 5/1972 | Baucke | |
| 4,436,302 A | * | 3/1984 | Frye et al. | 271/202 |
| 4,546,871 A | | 10/1985 | Duke | |
| 4,585,227 A | * | 4/1986 | Muller | 271/270 |
| 4,681,501 A | | 7/1987 | Edwards et al. | |
| 4,799,847 A | | 1/1989 | Bodewein | |
| 4,861,014 A | * | 8/1989 | Martin | 271/198 |
| 4,973,039 A | | 11/1990 | Jeske et al. | |
| 4,997,524 A | | 3/1991 | Nieminen et al. | |
| 5,158,278 A | | 10/1992 | Auf der Mauer | |
| 5,160,132 A | * | 11/1992 | Hanada | 271/258.01 |
| 5,810,350 A | | 9/1998 | Pollich | |
| 5,833,231 A | | 11/1998 | Schreiner | |
| 5,971,134 A | | 10/1999 | Trefz et al. | |
| 5,989,393 A | | 11/1999 | Kivimaa et al. | |
| 6,189,884 B1 | * | 2/2001 | Jeske | 271/182 |
| 6,196,540 B1 | | 3/2001 | Schmid et al. | |
| 6,290,817 B1 | | 9/2001 | Autio | |
| 6,338,482 B1 | * | 1/2002 | Geske et al. | 271/202 |
| 6,494,452 B1 | * | 12/2002 | Karasiewicz | 271/276 |

* cited by examiner

*Primary Examiner*—David H. Bollinger
(74) *Attorney, Agent, or Firm*—Andrus, Sceales, Starke & Sawall, LLP

(57) ABSTRACT

A shingling apparatus for sheets of paper or paperboard includes a pair of independently operable vacuum plenums in a gap between an in-feed conveyor and a reduced speed shingling conveyor. One of the vacuum plenums decelerates an incoming sheet to shingling conveyor speed while the second vacuum plenum captures and pulls down the tail of the sheet to allow the faster moving following sheet to override the tail. This dual vacuum action enhances sheet control, requires very little vertical displacement of the sheets at the vacuum plenums, and enhances the squareness of the shingle that is formed. The system may also include a downstream shingle separator including a translating connection that assists in pulling the necessary gap between downstream shingle portion being directed into a stacker and an upstream shingle portion that is accumulated until the downstream shingle portion is stacked and discharged.

19 Claims, 3 Drawing Sheets

DUAL MODULATED VACUUM SHINGLER

BACKGROUND OF THE INVENTION

The present invention pertains to a system for compressing a conveyed line of paper or paperboard sheets into a shingle and, more particularly, to such a system utilizing a dual plenum vacuum shingling device. The system may also include a shingle separation subsystem.

Vacuum shingling is well known and well developed in the art of handling sheets of paper and paperboard. When sheets of paper or paperboard are cut to length for further downstream conversion, they are usually delivered from a knife or other cutoff device as a high speed line of closely spaced sheets, often moving at a speed of 1,000 feet per second (about 300 meters per second) or more. In order to compress the line of sheets to facilitate handling, as for example for forming stacks of sheets, the line of sheets is formed into a shingle which continues to advance at a much reduced speed. In order to form a shingle, the sheets must be slowed considerably and handled in a manner such that the lead edge of each following sheet is made to overrun the tail edge of the sheet immediately preceding it. This may require the sheets to be slowed on a shingling conveyor to a speed that is only 20% of incoming line speed or less.

Because of wide variations in line speed at which the sheets are fed, the percent shingle (overlap) required, sheet length and basis weight of the paper or paperboard sheets, many different ways have been developed for shingling and for controlling sheets in the shingling process. Another complication is introduced when sheets are preprinted or finished on the exposed top sides such that contact of the sheets with overhead snubber wheels, brushes or the like is undesirable or impossible. In such cases, vacuum shingling by which the sheets are captured and slowed from line speed by applying a vacuum to the undersides of the sheets is a common practice.

Nevertheless, it would be desirable to have a vacuum shingling system that would be adaptable to handle a wider range of sheet sizes and basis weights, over a wide range of delivery line speeds and shingle overlap and, in particular, with a system that would not include devices that rub and could scuff finished upper sheet surfaces.

SUMMARY OF THE INVENTION

In accordance with the present invention, an apparatus is provided for shingling a line of sheets having sensitive surface quality that prevents the use of potentially scuffing surface engaging devices and for forming a shingle from sheets delivered at high in-feed speeds.

In a preferred embodiment, the apparatus includes an in-feed conveyor that carries a line of closely spaced sheets on a generally planar sheet conveying surface at a first speed; a shingling section that receives the line of sheets from the downstream end of the in-feed conveyor, including a shingling conveyor having a shingle forming surface operable at a second speed less than the first speed; a vacuum station that separates the in-feed conveyor and the shingling conveyor, the vacuum station including an upstream vacuum chamber having a first vacuum surface defining a first vacuum opening and an adjacent downstream vacuum chamber having a second vacuum surface defining a second vacuum opening; the first vacuum surface positioned to slope upward from an upstream edge positioned below the downstream end of the sheet conveying surface to a downstream edge adjacent the second vacuum surface, the second vacuum surface positioned to lie generally parallel to and at or below the plane of the sheet conveying surface of the in-feed conveyor; and a vacuum control operable to apply vacuum independently to the upstream chamber to drop the tail end of each sheet leaving the in-feed conveyor onto the first vacuum surface and to the downstream chamber to decelerate each sheet to the second speed.

Preferably, the upstream edge of the first vacuum surface is adjustably positioned in a range of bout 0.5–0.75 inch (about 13–19 mm) below the sheet conveying surface. The second vacuum surface is preferably adjustably positioned in a range of about 0–0.25 inch (about 0–6 mm) below the sheet conveying surface of the in-feed conveyor. In one embodiment, the first vacuum surface is upwardly convex and joins the upstream of the second vacuum surface at a generally horizontal tangent. The vacuum control is preferably operable to apply vacuum to the upstream and downstream chambers independently of one another.

In a presently preferred embodiment, an air nip is positioned over the shingling conveyor and includes a narrow slot that extends across the width of the sheets and is positioned to direct a thin stream of air against the lead edge of a sheet on the shingling conveyor to nip the sheet on the shingling conveyor during application of vacuum to the downstream vacuum chamber. The air nip may be adjustably positionable in the direction of sheet movement. Alternately, the apparatus may include a snubber wheel assembly that is positioned over the shingling conveyor and is operative to engage the lead edge of a sheet and to nip the sheet on the shingling conveyor during application of vacuum to the downstream vacuum chamber. The snubber wheel assembly may be adjustably positionable horizontally in the direction of sheet movement. In another embodiment, a vacuum conveyor belt is positioned to operate over the vacuum surfaces at the second speed. A cam roll may also be positioned between the vacuum surfaces, the cam roll having an inoperative surface portion below the vacuum surfaces and an operative position rotatable into sheet engaging position above the vacuum surfaces in response to said vacuum control.

In a further embodiment of the invention, a shingle separating apparatus is operatively connected to the downstream end of the shingling conveyor. The shingle separating apparatus preferably comprises a shingle separating conveyor; a vacuum plenum providing an operative connection between the shingling conveyor and the shingle separating conveyor, the vacuum plenum having a vacuum opening exposed to a shingle traveling thereover; a second vacuum control operable to apply vacuum from the vacuum opening to the tail end of a first sheet defining an upstream shingle portion to be separated from a downstream shingle portion; and, a shingle separating conveyor drive operative in response to the vacuum control to accelerate the shingle separating conveyor and the downstream shingle portion to a third speed greater than the second speed. The apparatus may include a nip roller device positioned over the shingle separating conveyor and operative in response to the second vacuum control to engage the last sheet of the downstream shingle portion. In a presently preferred embodiment, the shingle separating apparatus includes a shingle holding conveyor providing with the vacuum plenum the operative connection, and the shingle holding conveyor and the shingle separating conveyor comprise belt conveyors, each operating around respective pairs of head and tail pulleys; a first translating connection includes the vacuum plenum interconnecting the shingle holding conveyor head pulley and the shingle separating conveyor tail pulley; a second translating connection interconnecting the stub conveyor tail pulley and the shingle separating conveyor head pulley; and, a translation device that is operable to move the first translating connection downstream at a fourth speed to separate the downstream shingle portion from the upstream shingle portion. Preferably, the fourth speed is equal to the third speed.

The present invention also includes a method for shingling a line of sheets that are delivered in closely spaced relation from the downstream end of a generally horizontal in-feed conveyor, the method comprising the steps of: (1) positioning a first vacuum surface to slope upwardly from an upstream edge below the downstream end of the in-feed conveyor to a downstream edge; (2) positioning a second vacuum surface to extend generally horizontally downstream from adjacent the downstream edge of the first vacuum surface generally coplanar with or slightly below the plane of said in-feed conveyor to a downstream edge; (3) positioning a generally horizontal shingling conveyor to extend downstream from the downstream end of said second vacuum surface; (4) operating the in-feed conveyor at a first speed and operating said shingling conveyor at a second speed less than said first speed; (5) applying a vacuum to the second vacuum surface to decelerate each sheet to approach said second speed; (6) applying a vacuum to said first vacuum surface to drop the tail of each sheet leaving the in-feed conveyor onto the first vacuum surface; and (7) controlling the application of vacuum to said first and second vacuum surfaces in response to movement of the tail end of the sheet past each respective surface.

Preferably, the method also includes the step of adjustably positioning the upstream edge of the first vacuum surface in a range of about 0.5–0.75 inch (about 13–19 mm) below the in-feed conveyor. A method also preferably includes the step of adjustably positioning the second vacuum surface in a range of about 0–0.25 inch (about 0–6 mm) below the in-feed conveyor.

The method may also include the additional steps of (1) positioning a shingle separating conveyor downstream of the shingling conveyor; (2) connecting the upstream end of the shingle separating conveyor to a translating device including a vacuum plenum; and (3) operating the translating device to move the shingle separating conveyor and vacuum plenum downstream at a selected speed to separate a downstream shingle portion carried thereon from an upstream shingle portion.

DETAILED DESCRIPTION OF THE PREFERRED EMBODIMENTS

Figure 1:
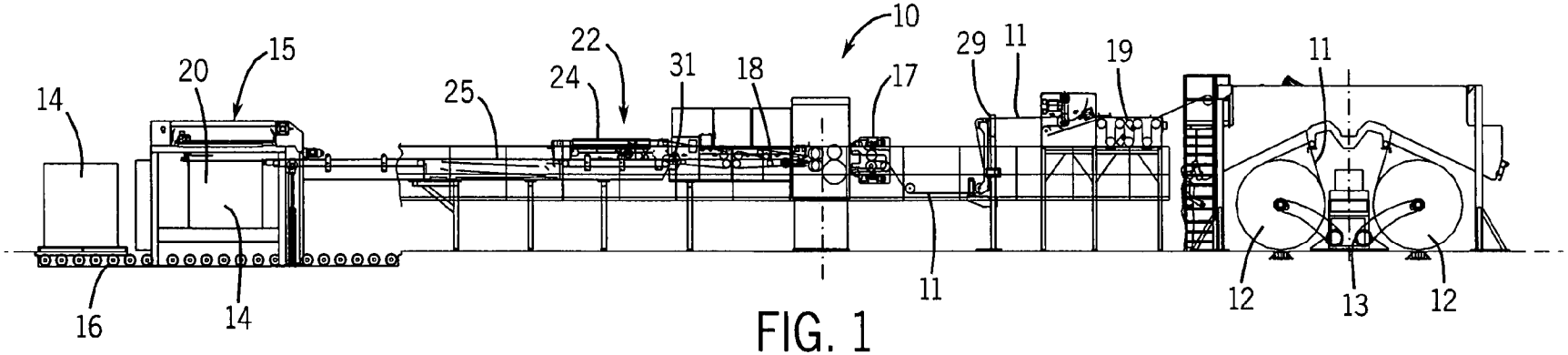
FIG. 1 is a generally schematic side elevation of a sheeter system incorporating the apparatus and performing the method of the subject invention.

Referring initially to FIG. 1, a sheeter 10 converts a paper or paperboard web 11 wound from a roll 12 mounted on a roll stand 13 to one or more streams of sheets 20 that are eventually accumulated in a vertical stack in a downstream stacker 15. The stacks are carried on pallets 16 for discharge from the stacker 15. In the sheeter system shown, the web 11 from one of the rolls 12 passes initially through a tension decurler 19 where the curl in the web resulting from winding on the roll is removed. The web then passes through a tension isolator and a web aligner 29 from which it is directed into a slitter 17 which slits the web 11 longitudinally into two or more parallel web portions. The slitter 17 may also include scoring tools that provide longitudinal score lines in the running web portions to, for example, facilitate subsequent folding of the converted sheets. The longitudinal web portions continue through a rotary cutoff knife 18 which severs each web portion laterally into a continuous stream of rectangular sheets 20 (see FIG. 3). The knife outfeed includes a sheet conveyor 21 that also comprises an in-feed conveyor to the vacuum shingler of the present invention. The sheet conveyor or in-feed conveyor 21 operates at a slight overspeed with respect to the speed of the web entering the cutoff knife 18 such that a small gap is pulled between the trailing edge of each cut sheet and the leading edge of the web that follows. Thus, the in-feed conveyor 21 carries a line of closely spaced sheets 20 into the dual modulated vacuum shingler 22 of the present invention.

In the shingler 22, the line of sheets 20 is compressed by shingling them one atop another by successively slowing each lead sheet in a manner permitting its lead edge to overlap the tail edge of the preceding sheet. The shingler includes a shingling conveyor 24 on which the shingle is formed operating at a substantially lower speed than the in-feed conveyor 21. Immediately downstream from the shingling conveyor 24, a shingle separator 25 separates and accelerates a downstream shingle portion which is conveyed into the stacker 15 to form a stack 14, while the gap between the downstream and upstream shingle portions created at the shingle separator 25 permits the stack 14 to be unloaded from the stacker which is then readied to receive and stack the following shingle portion.

It is critically important to form a shingle that is straight and square in order to achieve high stack quality in the stacker 15. In the industry, there are a number of methods used to reliably form a high quality shingle at high speeds. Most methods utilize a vacuum plenum between the in-feed conveyor and the shingling conveyor to help decelerate the sheets to the shingling conveyor speed. In addition, shinglers typically also utilize snubber wheels or rollers positioned above the upstream end of the shingling conveyor to form a decelerating nip with the shingling conveyor. The snubber wheels or rollers help decelerate the high speed sheets by nipping the lead edge of each sheet onto the trailing edge of the preceding sheet on the shingling conveyor 24 which, as indicated, is operating at a substantially lower speed than the in-feed conveyor 21. It is common, for example, to decelerate the sheets to 20% of the in-feed conveyor speed (creating an 80% overlap in the shingle). This rapid deceleration presents a significant challenge to maintaining squareness in the shingle and the difficulty increases as line speeds increase.

Webs 11 that are preprinted with graphics or provided with sensitive coatings often cannot tolerate scuff marks on the upper surface as a result of decelerating contact with snubber wheels or rollers. In accordance with one aspect of the present invention, the vacuum shingler 22 of the present invention provides reliable high speed shingling without the need for physically contacting the upper surfaces of the sheets in a manner that permits line speed as high as 1,500 fpm (about 8 mps).

Figure 2:
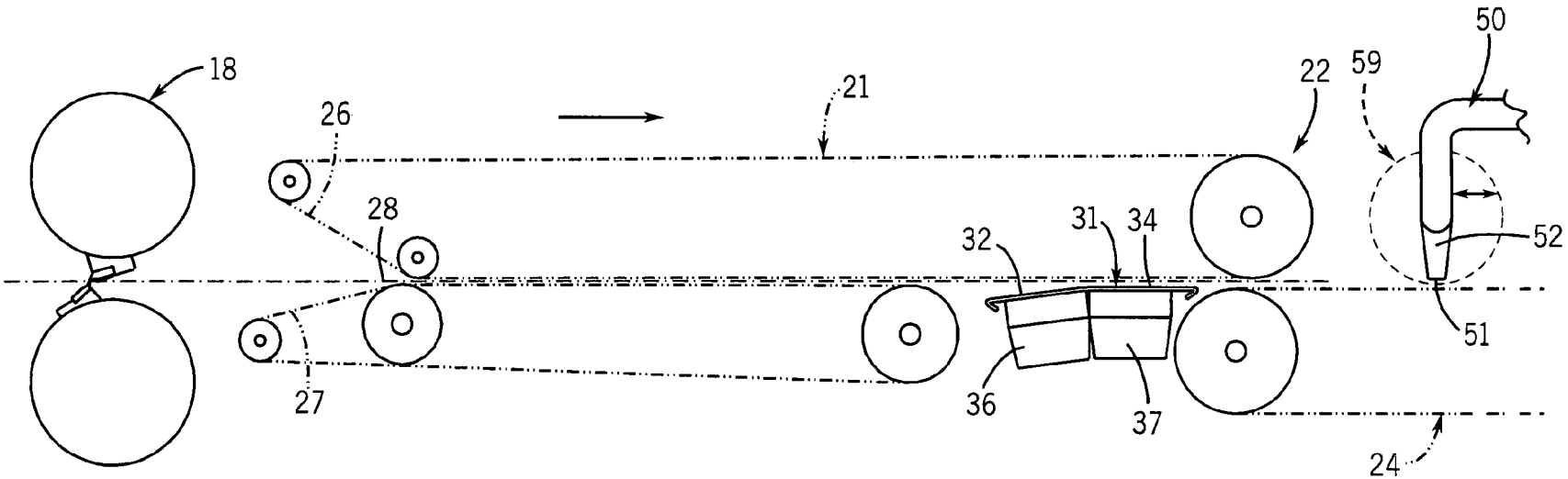
FIG. 2 is a schematic side elevation view of the dual modulated vacuum shingler of the present invention.
Figure 3:
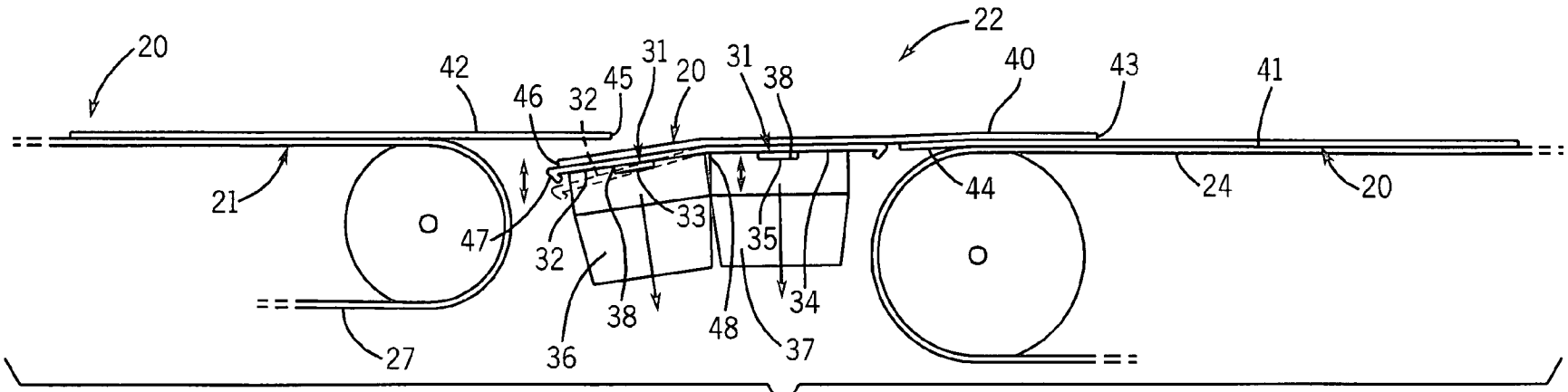
FIG. 3 is an enlarged detail of a portion of FIG. 2.

Referring now particularly to FIGS. 2 and 3, the in-feed conveyor 21, comprising upper and lower tape belts 26 and 27, captures the lead edge 28 of the web 11 just as the rotary cutoff knife 18 severs the web to form a sheet 20. The slight overspeed of the belts 26 and 27 with respect to web speed into the knife 18, creates a small gap between the trailing edge 30 of the cut sheet and the lead edge of the web moving into and through the knife, all in a manner well known in the art. The in-feed conveyor 21 carries the closely spaced sheets into the vacuum shingler 22 of the present invention where the sheets are serially captured in a vacuum section 31 and decelerated to the lower speed of the shingling conveyor 24. The vacuum section 31 includes an upstream first vacuum surface 32 that includes an upwardly sloping surface to which a vacuum is applied through a first vacuum slot 33. In the presently preferred embodiment, the first vacuum surface 32 is joined at its downstream edge with the upstream edge of a second vacuum surface 34 that is generally horizontally disposed and to which vacuum is applied via a second vacuum slot 35. Each of the vacuum surfaces 32 and 34 has its own vacuum plenum 36 and 37, respectively, so that vacuum may be applied to each separately. Vacuum through the respective slots 33 and 35 is selectively applied by a vacuum control such as a conventional sliding shuttle valve 38 which may also be controlled to modulate the vacuum force. It has been found that the use of dual vacuum plenums 36 and 37 greatly enhances sheet control and shingle quality. Furthermore, the timing of the application of vacuum to the sheets, as well as the modulation thereof, may be adjusted and controlled to provide optimum shingling for sheets of varying size and basis weight and for different in-feed conveyor speeds. The vertical positioning of the vacuum plenums may also be adjusted within a relatively small range, again based on sheet parameters and line speed. In particular, the use of two independently controlled vacuum plenums permits shingling to be effectively accomplished with a very small vertical displacement of the sheets from the plane of the in-feed conveyor, thereby minimizing the opportunity for sheet misalignment. Finally, effective shingling may be accomplished without the use of snubber wheels over the shingling conveyor but, if the sheet and operating parameters require some additional nipping force, the system of the present invention includes an air nip to provide a supplemental downward nipping force on the sheet being shingled.

In FIG. 3, an intermediate sheet 40 is shown under the control of the vacuum section 31 with the leading edge 43 of the intermediate sheet 40 overlapping (shingled on) the trailing edge 44 of a lead sheet 41 on the shingling conveyor 42. Using the system vacuum control (not shown, but of a conventional construction), vacuum is applied to the second (downstream) vacuum surface 34 as soon as the leading edge 43 of intermediate sheet 40 reaches the vacuum slot 35. The vacuum force captures the sheet 40 and decelerates it to the lower speed of the shingle conveyor 24 or to an even lower speed. However, as is well known in the art, the leading edge 45 of the next trailing sheet 42 (which is traveling at the much higher in-feed speed) will quickly overtake the intermediate sheet 40 and, if some means of dropping trailing edge of the intermediate sheet is not provided, edge butt will occur between the intermediate sheet 40 and the trailing sheet 42, resulting in disruption of the shingle. Thus, as the trailing edge 46 of the intermediate sheet 40 leaves the downstream end of the in-feed conveyor 21, vacuum is applied by the controller to the first vacuum plenum 36 and the trailing end of the intermediate shingle 40 is sucked down onto the first vacuum surface 32 by the vacuum applied through the slot 33. This clears the trailing edge 46 of sheet 40 so the leading edge 45 of the next sheet 42 can begin to override it without disruptive contact.

The upstream edge 47 of the first vacuum surface 32 may be vertically positioned, as shown by the double-headed arrow adjacent edge 47 in FIG. 3, below the plane of the in-feed conveyor 21 by a small distance, preferably variable within a range of about 0.5–0.75 inch (about 13–19 mm). The first vacuum surface slopes upwardly from its upstream edge such that it joins the upstream edge 48 of the second vacuum surface 34 at a generally horizontal tangent line. The first vacuum surface 32 may be curved and upwardly convex, as shown in the broken line in FIG. 3, to provide smooth transition of the sheets. The second vacuum surface 34 is preferably disposed horizontally and is vertically adjustable, as shown by the double-headed arrow below surface 34 in Fig 3, within a small range of coplanar with the in-feed conveyor 21 (sometimes referred to as board pass height) to a position about 0.25 inch (about 6 mm) below the plane of the in-feed conveyor. Adjustments of the vertical position of the first and second vacuum surfaces 32 and 34, again, depends on many variables including sheet length, sheet basis weight, in-feed line speed and shingling conveyor speed.

In order to operate at higher line speeds and correspondingly higher shingling speeds, it may be necessary to provide a supplemental nipping force to assist the sheet stopping force applied by the second vacuum plenum 37. This supplemental nipping force is applied downwardly to nip the sheet on the shingling conveyor 24 just as the trailing edge of the sheet leaves the in-feed conveyor and the vacuum controller applies a vacuum to the second vacuum surface 34 to decelerate the sheet. However, because rotary snubber wheels can damage sensitive pre-printed or coated sheet surfaces, an air nip 50, positioned over the shingling conveyor 24, is used to provide this supplemental nipping force. The air nip 50 comprises a thin slit 51 that extends the full width of the sheets through which compressed air is blown to create a uniform air curtain directed downwardly against the sheet. The air nip nozzle 52 may be adjustable vertically as well as rotationally around a horizontal axis so that the air curtain may be directed either slightly in an upstream direction or a downstream direction, depending on sheet and operating parameters. The air controller may also be operated to modulate the air flow and thus the force of the air nip. In addition, the air nip 50 may be adjustably positioned longitudinally over the shingling conveyor, as shown by the double-headed arrow adjacent the air nip 50 in FIG. 2, to accommodate varying sheet lengths. Of course, if sheet surface quality is not an issue, conventional snubber wheels 59, shown in phantom in FIG. 2, may be used instead. A supplemental nipping force may also be applied by alternate means, including tape belts that are located above the shingle. The belts are adjustable vertically to move down to nip the shingle against the shingling conveyor 24. Such nipping belts may also be positioned to provide a downward nip force on the vacuum section 31, including a modified section utilizing FIG. 6 cam roller.

Figure 6:
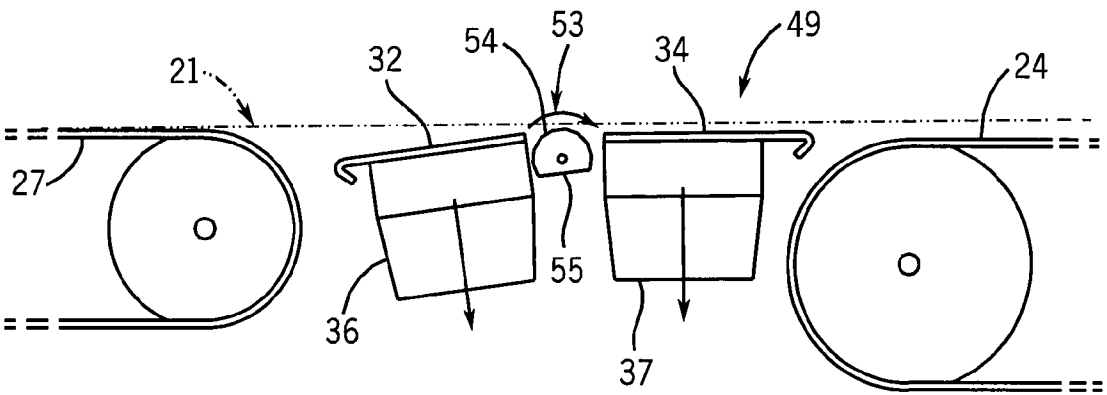
FIG. 6 is an alternate embodiment of the vacuum section shown in FIG. 3.

FIG. 6 shows a modification of the vacuum section 31 previously described and shown in FIG. 3. In FIG. 6, the first and second vacuum plenums 36 and 37 have been separated and a cam roller 53, rotatable on a horizontal axis, is positioned between the plenums. Instead of a roller, a series of axially spaced cam wheels could be substituted. The cam roller 53 has a cylindrical surface 54 that makes tangent contact with the underside of a sheet (such as intermediate sheet 40) moving over the modified vacuum section 49. The cam roller 53 also has a flat surface 55 which, when the roller 53 is rotated 180° from the position shown in FIG. 6, places the flat surface out of contact with a sheet traveling through the vacuum section 49. Rotation of the cam roller 53 is timed to coincide with release of the vacuum from the vacuum plenums 36 and 37 so that the roller is rotated through the arc of its cylindrical surface 54 (in the direction shown by the arrow) to contact the sheet and assist in moving it onto the shingling conveyor. The cam roller 53 may be used as a substitute for the air nip 50 or the snubber wheels 59, or in addition to either.

As an alternate to the cam roller 53, a porous vacuum belt (not shown) could be mounted to operate over the vacuum surfaces 32 and 34 at shingling conveyor speed to assist in moving the sheets. Operation of the porous vacuum belt may be timed to coincide with the application of vacuum to vacuum plenums or the belt could be operated continuously.

Figure 4:
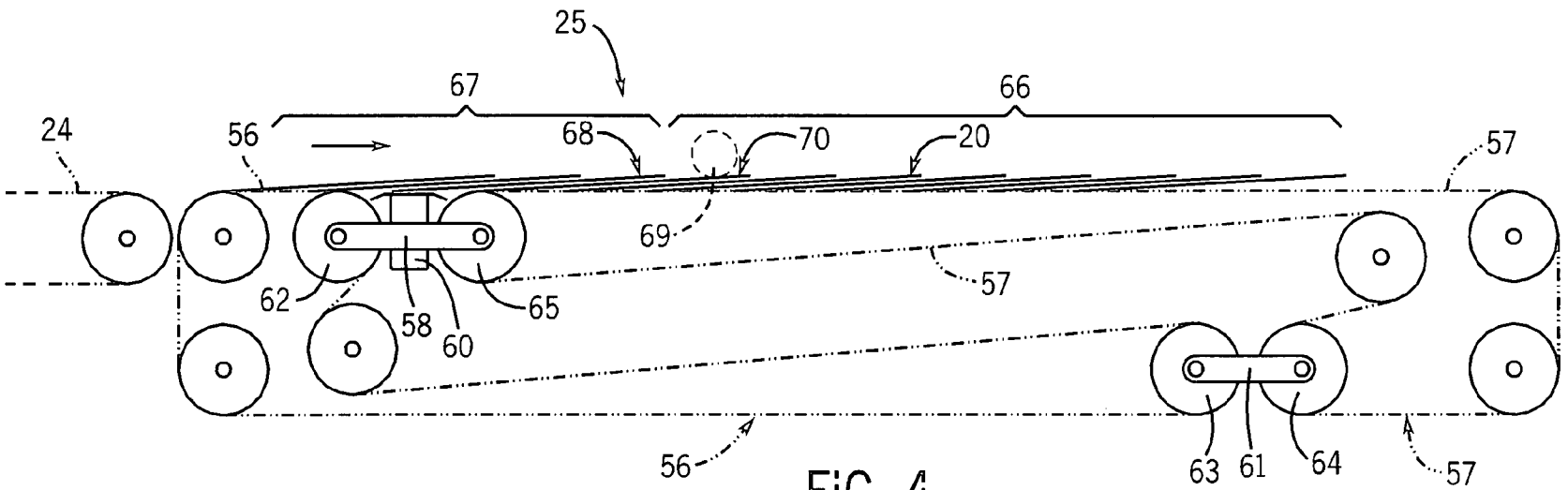
FIG. 4 is a generally schematic side elevation of the shingle separating conveyor of the present invention showing thereon a line of shingled sheets.
Figure 5:
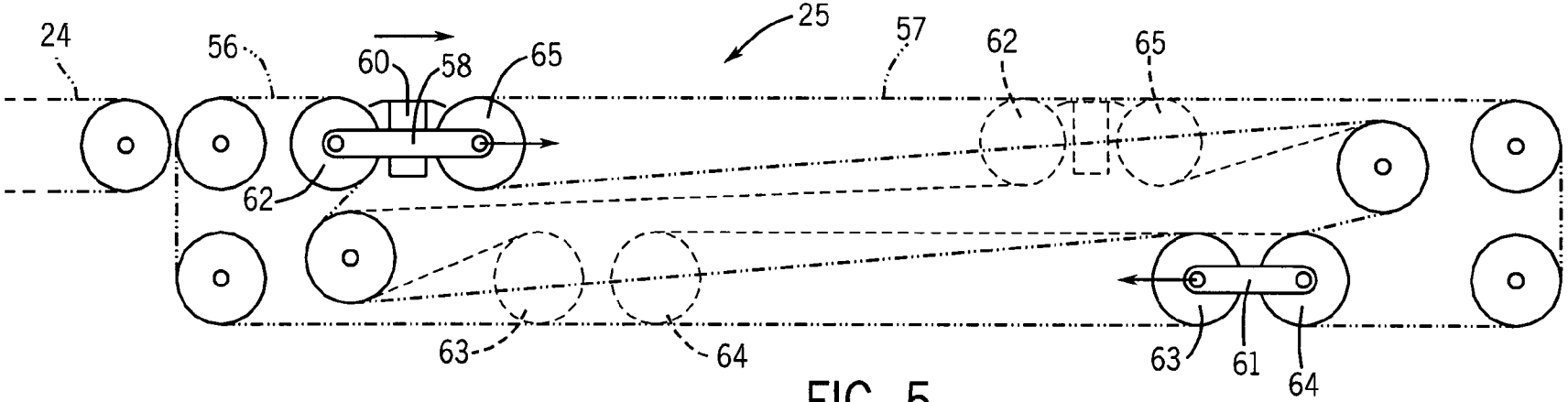
FIG. 5 is a side elevation view similar to FIG. 4 showing the downstream translation of the shingle separating conveyor.

FIGS. 4 and 5 show details of the shingle separator 25 which is positioned immediately downstream of the shingling conveyor 24. The shingle separator includes two independently operable conveyors comprising an upstream shingle holding conveyor 56 and a downstream shingle separating conveyor 57 which are interconnected with a first translating connection 58 that includes a vacuum plenum 60. The respective opposite ends of the conveyors 56 and 57 are interconnected with a second translating connection 61. The holding conveyor 56 and the separating conveyor 57 may comprise any type of suitable belt conveyor, such as tape belt conveyors. The shingle holding conveyor 56 includes a head pulley 62 and a tail pulley 63. Similarly, the shingle separating conveyor includes a head pulley 64 and a tail pulley 65. The first translating connection 58 (including the vacuum plenum 60) interconnects the holding conveyor head pulley 64 and the separating conveyor tail pulley 65. Correspondingly, the second translating connection 61 interconnects the holding conveyor tail pulley 63 and the separating conveyor head pulley 64.

In operation, the holding conveyor 56 and the separating conveyor 57 are positioned as shown in FIG. 4 and operated together at the same speed as the upstream shingling conveyor 24. When it is desired to separate a downstream shingle portion 66 from an upstream shingle portion 67 to create a gap therebetween to facilitate operation of the stacker 15, the separating conveyor 57 is accelerated and vacuum is applied to the vacuum plenum 60 to capture the lead edge of first sheet 68 of the upstream shingle portion 67. Acceleration of the shingle separating conveyor 57 pulls the downstream shingle portion 68 away from the upstream shingle portion 67. A nip roll 69 in contact with the last sheet 70 of the downstream shingle portion may be used to help assure that the last sheet 70 is pulled free of the singled first sheet 68 of the upstream shingle portion. Simultaneously, the first translating connection 58 is operated to move downstream at the same speed as the accelerated separating conveyor 57 carrying the downstream shingle portion 66. This movement provides a gap between the shingle portions 66 and 67 which permits the upstream shingle portion 67 to be accumulated while the downstream shingle portion 66 is cleared from the separating conveyor 57 for stacking. It should be noted that the second translating connection 61 moves with the first translating connection 58 at the same speed but in the opposite direction, as shown in phantom in FIG. 5. After the downstream shingle portion 66 is cleared from the separating conveyor 57, the separating conveyor is slowed to the speed of the holding conveyor 56 and the shingling conveyor 24. The vacuum to vacuum plenum 60 is shut off, releasing the first sheet 68 of the upstream shingle portion 67 and the first translating connection 58 is reversed and moved back to the FIG. 4 starting position.

I claim:

1. An apparatus for forming and delivering a line of shingled sheets comprising:

an in-feed conveyor carrying a line of closely spaced sheets, on a generally planar sheet conveying surface at a first speed;

a shingling section receiving the line of spaced sheets from the downstream end of the in-feed conveyor, said shingling section including a shingling conveyor having a shingle forming and conveying surface, said shingling conveyor operable at a second speed less then said first speed;

a vacuum station separating the in-feed conveyor and the shingling conveyor, said vacuum station including an upstream vacuum chamber having a first vacuum surface defining a first vacuum opening and an adjacent downstream vacuum chamber having a second vacuum surface defining a second vacuum opening;

said first vacuum surface sloping upwardly from an upstream edge positioned below the downstream end of the sheet conveying surface to a downstream edge adjacent the second vacuum surface, said second vacuum surface lying generally parallel to and at or below the plane of the sheet conveying surface of the in-feed conveyor; and, a vacuum control operable to apply vacuum to the upstream chamber to drop the tail end of each sheet leaving the in-feed conveyor onto the first vacuum surface and to the downstream chamber to decelerate each sheet to said second speed.

2. The apparatus as set forth in claim 1 wherein the upstream edge of said first vacuum surface is vertically positioned in a range of about 0.5 to 0.75 inch (about 13 to 19 mm) below the sheet conveying surface.

3. The apparatus as set forth in claim 1 wherein said second vacuum surface is vertically adjustable in a range of about 0 to 0.25 inch (about 0 to 6 mm) below the sheet conveying surface.

4. The apparatus as set forth in claim 1 wherein said first vacuum surface is upwardly convex and joins the upstream edge of said second vacuum surface at a generally horizontal tangent.

5. The apparatus as set forth in claim 1 wherein said vacuum control is operable to independently apply vacuum to said upstream and downstream chambers.

6. The apparatus as set forth in claim 1 including an air nip positioned over the shingling conveyor and having a narrow slot extending across the width of the sheets and positioned to direct a thin stream of air against the lead edge of a sheet on the shingling conveyor to nip the sheet on the shingling conveyor during application of vacuum to the downstream vacuum chamber.

7. The apparatus as set forth in claim 6 wherein said air nip is adjustably positioned longitudinally in the direction of sheet movement.

8. The apparatus as set forth in claim 1 including a snubber wheel assembly positioned over the shingling conveyor and operative to engage the lead edge of a sheet and nip the same on the shingling conveyor during application of vacuum to the downstream vacuum chamber.

9. The apparatus as set forth in claim 1 including a vacuum conveyor belt positioned to operate over said vacuum surfaces at said second speed.

10. The apparatus as set forth in claim 1 including a cam roll positioned between said vacuum surfaces, said cam roll having an inoperative surface portion below said vacuum surfaces and an operative portion rotatable into a sheet engaging position above said vacuum surfaces in response to said vacuum control.

11. The apparatus as set forth in claim 1 including a shingle separating apparatus operatively connected to the downstream end of the shingling conveyor.

12. The apparatus as set forth in claim 11 wherein said shingle separating apparatus comprises:

a shingle separating conveyor;

a shingle holding conveyor;

a vacuum plenum providing an operative connection between the shingle holding conveyor and the shingle separating conveyor, said vacuum plenum having a vacuum opening exposed to a shingle traveling thereover;

a second vacuum control operable to apply vacuum from said vacuum opening to the tail end of a first sheet defining an upstream shingle portion to be separated from a downstream shingle portion; and, a shingle separating conveyor drive operative in response to said second vacuum control to accelerate said shingle separating conveyor and said downstream shingle portion to a third speed greater than said second speed.

13. The apparatus as set forth in claim 12 including a nip roller apparatus positioned over the shingle separating conveyor and operative in response to said second vacuum control to engage the last sheet of said downstream shingle portion.

14. The apparatus as set forth in claim 12 wherein said shingle separating apparatus includes a shingle holding conveyor providing with said vacuum plenum the operative connection, and wherein said holding conveyor and said shingle separating conveyor comprise belt conveyors, each operating around respective pairs of head and tail pulleys;

a first translating connection including said vacuum plenum interconnecting the holding conveyor head pulley and the shingle separating conveyor tail pulley;

a second translating connection interconnecting the holding conveyor tail pulley and the shingle separating conveyor head pulley; and, a translation device operable to move said first translating connection downstream at a fourth speed to separate said downstream shingle portion from said upstream shingle portion.

15. The apparatus as set forth in claim 14 wherein said fourth speed is equal to said third speed.

16. A method for shingling a line of sheets delivered in closely spaced orientation from the downstream end of a an in-feed conveyor, said method comprising the steps of:

(1) positioning a first vacuum surface to slope upwardly from an upstream edge below a downstream end of a generally horizontal in-feed conveyor to a downstream edge;

(2) positioning a second vacuum surface to extend generally horizontally downstream from adjacent the downstream edge of the first vacuum surface generally coplanar with or slightly below the plane of said in-feed conveyor to a downstream edge;

(3) positioning a generally horizontal shingling conveyor to extend downstream from the downstream end of said second vacuum surface;

(4) operating said in-feed conveyor at a first speed and operating said shingling conveyor at a second speed less than said first speed;

(5) applying a vacuum to said second vacuum surface to decelerate each sheet to approach said second speed (6) applying a vacuum to said first vacuum surface to drop the tail end of each sheet leaving the in-feed conveyor onto the first vacuum surface; and (7) controlling the application of vacuum to said first and second vacuum surfaces in response to movement of the tail end of the sheet past each respective surface.

17. The method as set forth in claim 16 including the step of adjustably positioning the upstream edge of said first vacuum surface in a range of about 0.5 to 0.75 inch (about 13 to 19 mm) below the infeed conveyor.

18. The method as set forth in claim 16 including the step of adjustably positioning said second vacuum surface in a range of about 0 to 0.25 inch (about 0 to 6 mm) below the infeed conveyor.

19. The method as set forth in claim 16 including the additional steps of:

(1) positioning a shingle separating conveyor downstream of said shingling conveyor;

(2) connecting the upstream end of the shingle separating conveyor to a translating device including a vacuum plenum; and, (3) operating said translating device to move the shingle separating conveyor and vacuum plenum downstream at a selected speed to separate a downstream shingle portion carried thereon from an upstream shingle portion.

* * * * *